US012098722B2

(12) United States Patent
Latham

(10) Patent No.: US 12,098,722 B2
(45) Date of Patent: Sep. 24, 2024

(54) METHOD FOR DETERMINING A DISCHARGE PRESSURE OF A ROLLING PISTON COMPRESSOR

(71) Applicant: Haier US Appliance Solutions, Inc., Wilmington, DE (US)

(72) Inventor: Joseph Wilson Latham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 234 days.

(21) Appl. No.: 17/752,216

(22) Filed: May 24, 2022

(65) Prior Publication Data

US 2023/0383741 A1 Nov. 30, 2023

(51) Int. Cl.

| | |
|---|---|
| ***F04C 28/08*** | (2006.01) |
| ***F04B 49/08*** | (2006.01) |
| ***F04C 18/324*** | (2006.01) |
| ***F04C 18/356*** | (2006.01) |
| ***F04C 28/28*** | (2006.01) |

(Continued)

(52) U.S. Cl.

CPC ..... *F04C 28/08* (2013.01); *F04B 49/08* (2013.01); *F04C 18/324* (2013.01); *F04C 18/3562* (2013.01); *F04C 28/28* (2013.01); *F04B 49/065* (2013.01); *F04C 14/12* (2013.01); *F04C 2240/40* (2013.01); *F04C 2270/01* (2013.01); *F04C 2270/03* (2013.01); *F04C 2270/18* (2013.01); *F04C 2270/605* (2013.01)

(58) Field of Classification Search

CPC ..... F04C 28/08; F04C 28/28; F04C 18/324; F04C 18/3562; F04C 2240/40; F04C 2270/01; F04C 2270/03; F04C 2270/18; F04C 2270/605; F04B 49/08; F04B 49/065

See application file for complete search history.

(56) References Cited

U.S. PATENT DOCUMENTS

| | | |
|---|---|---|
| 7,392,158 B2 | 6/2008 | Hikawa et al. |
| 9,885,508 B2 | 2/2018 | Schuster et al. |

(Continued)

*Primary Examiner* — Charles G Freay

(74) *Attorney, Agent, or Firm* — Dority & Manning, P.A.

(57) ABSTRACT

A method of operating a rolling piston compressor includes determining a pressure difference (ΔP) between a discharge pressure ($P_d$) within a compression volume and a suction pressure ($P_s$) within a suction volume; determining a pressure ratio ($r_p$) equal to the discharge pressure ($P_d$) over the suction pressure ($P_s$); estimating a discharge pressure ($P_d$) based at least in part on the pressure difference (ΔP) and the pressure ratio ($r_p$); determining that the discharge pressure ($P_d$) is greater than a predetermined pressure limit ($P_{d\text{-}limit}$); and lowering a target speed ($\omega_{target}$) of the rolling piston compressor.

20 Claims, 8 Drawing Sheets

(51) Int. Cl.
*F04B 49/06* (2006.01)
*F04C 14/12* (2006.01)

(56) References Cited

U.S. PATENT DOCUMENTS

| | | | | |
|---|---|---|---|---|
| 10,273,948 | B1 | 4/2019 | Goodjohn et al. | |
| 10,823,172 | B2 * | 11/2020 | Latham | F04C 28/08 |
| 2021/0025380 | A1 * | 1/2021 | Aoyagi | F04D 27/0261 |

* cited by examiner

METHOD FOR DETERMINING A DISCHARGE PRESSURE OF A ROLLING PISTON COMPRESSOR

FIELD OF THE INVENTION

The present subject matter relates generally to compressors and associated methods of operation, and more particularly, to methods for monitoring and regulating discharge pressures within a rolling piston compressor.

BACKGROUND OF THE INVENTION

Certain conventional air conditioning and refrigeration systems use sealed systems to move heat from one location to another. Certain sealed systems may perform either a refrigeration cycle (e.g., to perform a cooling operation in an appliance such as a refrigerator) or a heat pump cycle (e.g., to heat an indoor room) depending on the appliance and the desired direction of heat transfer. However, the operating principles of both cycles or modes of operation are identical.

Specifically, sealed systems include a plurality of heat exchangers coupled by a fluid conduit charged with refrigerant. A compressor continuously compresses and circulates the refrigerant through the heat exchangers and an expansion device to perform a vapor-compression cycle to facilitate thermal energy transfer. In most sealed systems, an electric motor directly drives the compressor to compress a refrigerant. Notably, such sealed systems often have a certain burst pressure limit per appliance safety standards or regulatory standards. The highest pressures in such systems are typically seen in the discharge line of the compressor. Accordingly, this discharge pressure is typically monitored using one or more pressure sensors or monitoring systems. However, it is costly and difficult to added pressure sensors to such systems. Certain sealed systems utilize a pressure switch which is less costly, but typically results in shutting off the system when the limit is reached, rather than mitigating the excessive pressures.

Accordingly, an improved method for monitoring pressures within a sealed system would be desirable. More particularly, a method of operating a rolling piston compressor while monitoring discharge pressures without the use of expensive and complex sensing systems would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a method for operating a rolling piston compressor is provided. The rolling piston compressor includes a casing defining a cylindrical cavity defining a central axis, a suction port, and a discharge port, a rolling piston positioned within the cylindrical cavity, and a sliding vane that extends from the casing toward the rolling piston to maintain contact with the rolling piston as it rotates about a central axis, the sliding vane and the rolling piston dividing the cylindrical cavity into a suction volume in fluid communication with the suction port and a compression volume in fluid communication with the discharge port. The method includes estimating a discharge pressure ($P_d$) within the compression volume based at least in part on a load torque ($T_L$) and a load torque angle ($\theta_m$), determining that the discharge pressure ($P_d$) is greater than a predetermined pressure limit ($P_{d\text{-}limit}$), and adjusting at least one operating parameter of the rolling piston compressor to decrease the discharge pressure ($P_d$).

In another exemplary embodiment, a rolling piston compressor is provided including a casing defining a cylindrical cavity defining a central axis, a suction port, and a discharge port, an electric motor comprising a drive shaft, the drive shaft extending along the central axis, a rolling piston positioned within the cylindrical cavity, the rolling piston being eccentrically mounted on the drive shaft, a sliding vane that extends from the casing toward the rolling piston to maintain contact with the rolling piston as it rotates about the central axis, the sliding vane and the rolling piston dividing the cylindrical cavity into a suction volume in fluid communication with the suction port and a compression volume in fluid communication with the discharge port, and a controller operably coupled to the electric motor. The controller is configured to estimate a discharge pressure ($P_d$) within the compression volume based at least in part on a load torque ($T_L$) and a load torque angle ($\theta_m$), determine that the discharge pressure ($P_d$) is greater than a predetermined pressure limit ($P_{d\text{-}limit}$), and adjust at least one operating parameter of the rolling piston compressor to decrease the discharge pressure ($P_d$).

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
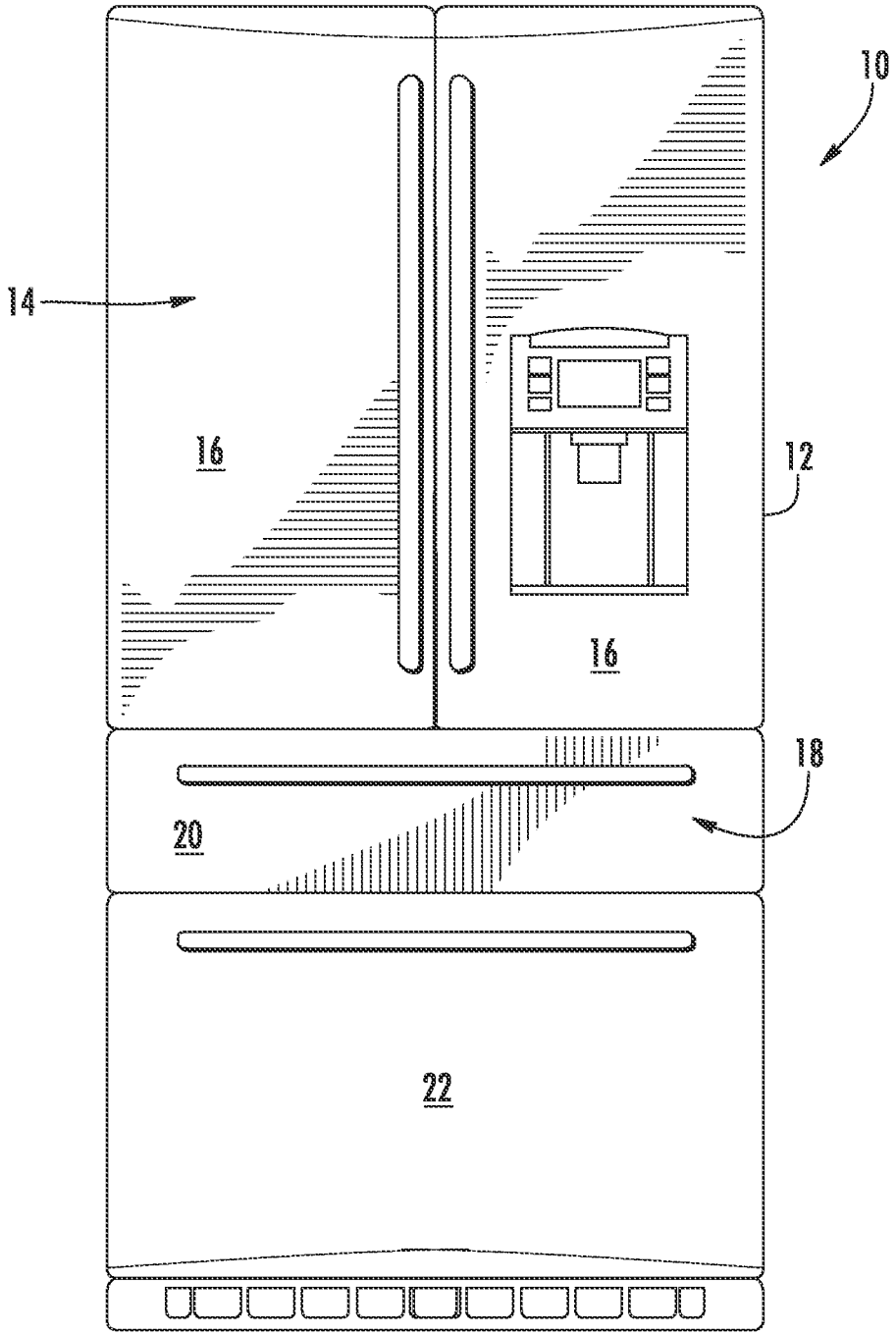
FIG. 1 is a front elevation view of a refrigerator appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
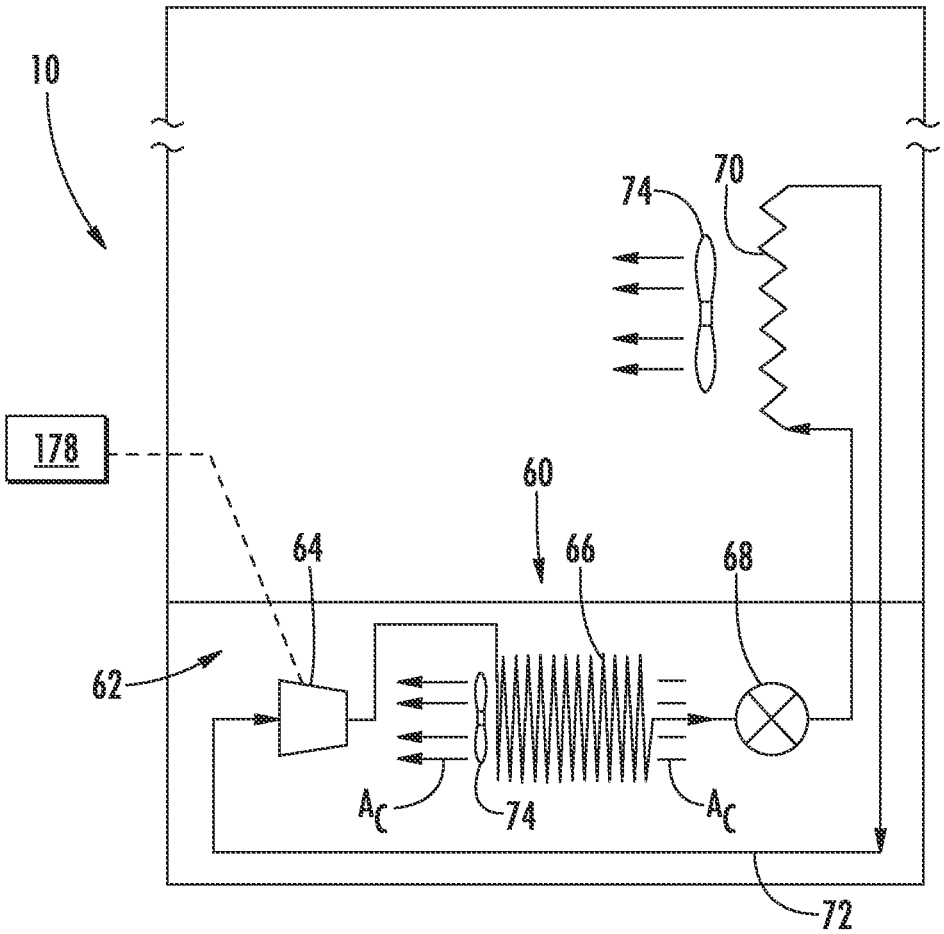
FIG. 2 is a schematic view of certain components of the example refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in refrigerator appliances. Thus, the present subject matter may be used for any other suitable purpose, such as vapor compression within air conditioning units or air compression within air compressors.

In the illustrated example embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series by fluid conduit 72 that is charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 74 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device 68 (e.g., a valve, capillary tube, or other restriction device) receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

As described above, sealed refrigeration system 60 performs a vapor compression cycle to refrigerate compartments 14, 18 of refrigerator appliance 10. However, as is understood in the art, refrigeration system 60 is a sealed system that may be alternately operated as a refrigeration assembly (and thus perform a refrigeration cycle as described above) or a heat pump (and thus perform a heat pump cycle). Thus, for example, aspects of the present subject matter may similarly be used in a sealed system for an air conditioner unit, e.g., to perform by a refrigeration or cooling cycle and a heat pump or heating cycle. In this regard, when a sealed system is operating in a cooling mode and thus performs a refrigeration cycle, an indoor heat exchanger acts as an evaporator and an outdoor heat exchanger acts as a condenser. Alternatively, when the sealed system is operating in a heating mode and thus performs a heat pump cycle, the indoor heat exchanger acts as a condenser and the outdoor heat exchanger acts as an evaporator.

Figure 3:
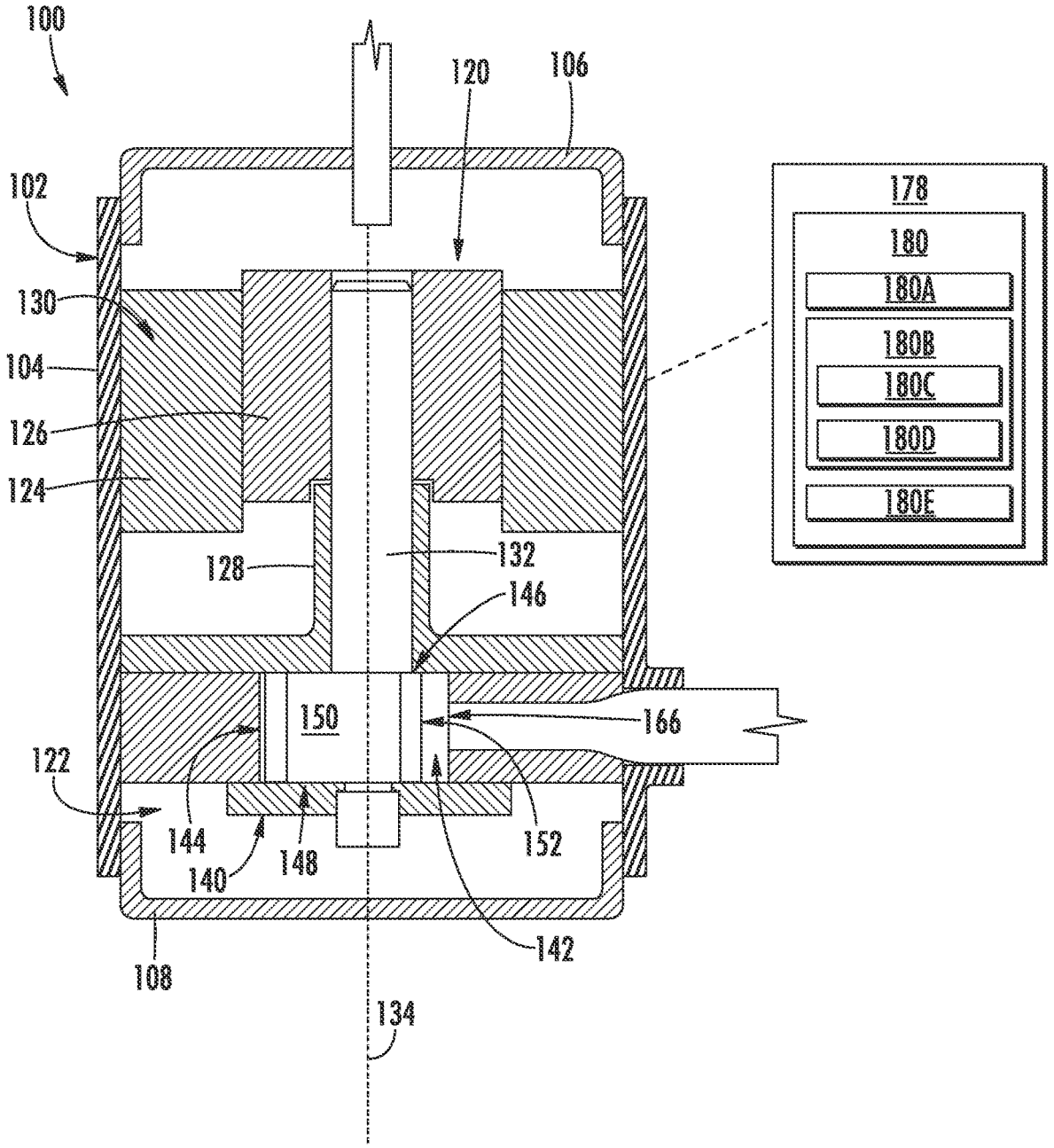
FIG. 3 is a cross sectional view of a rolling piston rotary compressor that may be used in the example refrigerator appliance of FIG. 1 according to an example embodiment of the present subject matter.

Referring now to FIG. 3, a compressor 100 will be described according to an exemplary embodiment of the present subject matter. Compressor 100 may be the same or similar to compressor 64 used in sealed refrigeration system 60. Alternatively, compressor 100 may be used in any other appliance or device for urging a flow of refrigerant through a sealed system. Moreover, it should be appreciated that aspects of the present subject matter may be adapted for use with other compressor types and configurations.

According to the illustrated exemplary embodiment, compressor 100 is a rolling piston rotary compressor including a housing 102 for containing various components of compressor 100. Housing 102 generally includes a cylindrical outer shell 104 that extends between a top shell 106 and a bottom shell 108. Housing 102 may generally form a hermetic or air-tight enclosure for containing compressor 100 components. In this manner, housing 102 generally keeps harmful contaminants outside housing 102 while preventing refrigerant, oil, or other fluids from leaking out of compressor 100.

Compressor 100 includes an electric motor 120 and a pump assembly 122 which are operably coupled and positioned within housing 102. More specifically, referring to FIG. 3, electric motor 120 generally includes a stator 124 positioned within housing 102 and a rotor 126 rotatably positioned within the stator 124. Stator 124 may be mechanically coupled within housing 102 (e.g., by one or more mechanical fasteners or through a compression fit) such that rotation relative to housing 102 is prevented. By contrast, rotor 126 is rotatably mounted using one or more bearings 128. When energized with the appropriate power, rotor 126 is caused to rotate while stator 124 remains fixed. For example, according to an exemplary embodiment, magnetic windings 130 are attached to stator 124. Each magnetic winding 130 may be formed from insulated conductive wire. When assembled, the magnetic windings 130 may be circumferentially positioned about rotor 126 to electromagnetically engage and drive rotation of rotor 122.

In addition, electric motor 120 may include a drive shaft 132 that extends from rotor 126, e.g., for driving pump assembly 122. Specifically, as illustrated, drive shaft 132 extends out of a bottom of rotor 126 along a central axis 134 and may be mechanically coupled to pump assembly 122. It should be appreciated that electric motor 120 may include any suitable type or configuration of motor and is not intended to be limited to the exemplary configuration shown and described herein. For example, the electric motor may be any other suitable AC motor, an induction motor, a permanent magnet synchronous motor, or any other suitable type of motor.

Figure 4:
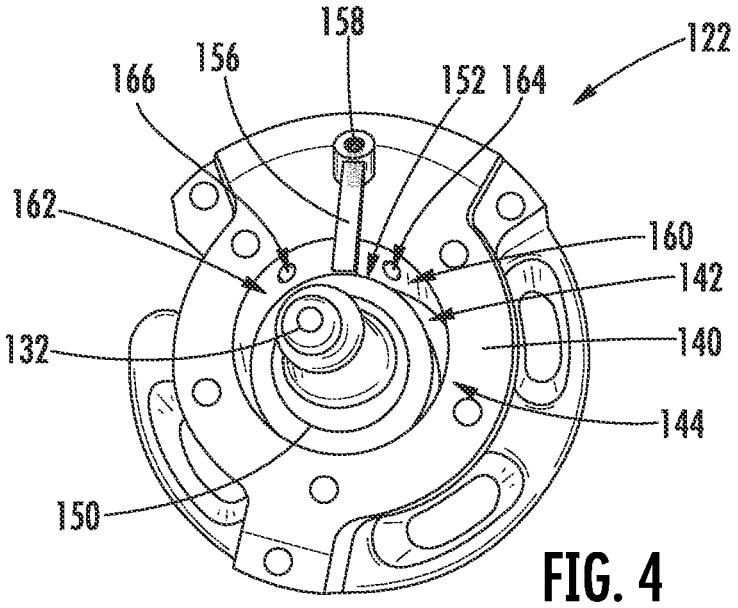
FIG. 4 provides a perspective cross sectional view of the exemplary rolling piston rotary compressor of FIG. 3.
Figure 5:
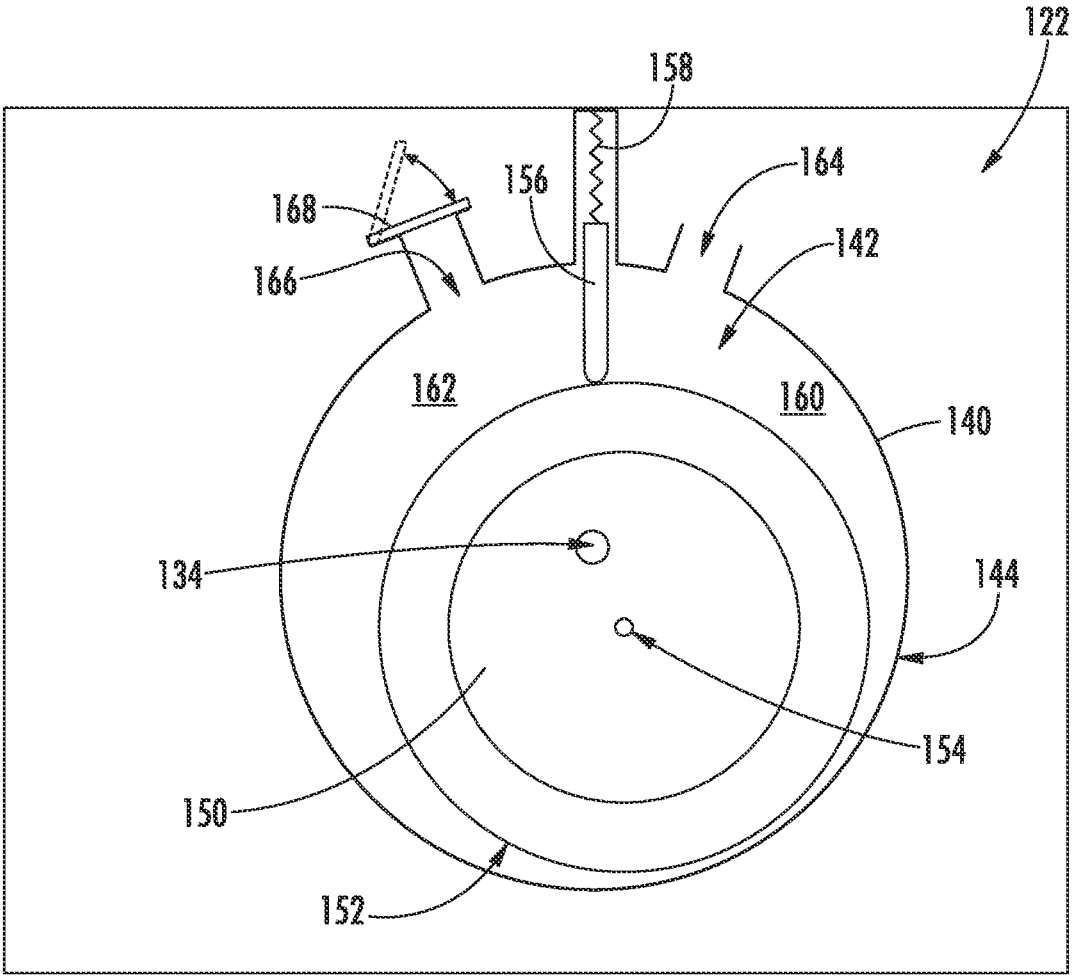
FIG. 5 provides a schematic, cross sectional view of the example rolling piston rotary compressor of FIG. 3.

Referring now to FIGS. 3 through 5, pump assembly 122 will be described in more detail according to an exemplary embodiment. As illustrated, pump assembly 122 is positioned within housing 102 and includes a casing 140 that defines a cylindrical cavity 142 within which the refrigerant compression occurs. Specifically, according to the illustrated embodiment, cylindrical cavity 142 defines a central axis which coincides with central axis 134 of drive shaft 132. Specifically, casing 140 may be formed from a cylindrical outer wall 144 that extends between a top wall 146 and a bottom wall 148 that are spaced apart along central axis 134.

As illustrated, a rolling piston 150 is positioned within cylindrical cavity 142 and is generally used for compressing refrigerant. Notably, rolling piston 150 may extend between top wall 146 and bottom wall 148 and define a cylindrical outer surface 152 that rolls along cylindrical outer wall 144 of casing 140. More specifically, rolling piston 150 is eccentrically mounted on drive shaft 132, e.g., such that a center of piston mass 154 is offset or not coincident with central axis 134.

In addition, pump assembly 122 includes a sliding vane 156 that extends from casing 140 toward rolling piston 150 to maintain contact with cylindrical outer surface 152 of rolling piston 150 as it rotates about central axis 134. Similar to rolling piston 150, sliding vane 156 generally extends between top wall 146 and bottom wall 148 of casing 140. Sliding vane 156 is urged into constant contact with rolling piston 150, e.g., using a spring element 158, such as a coiled mechanical spring.

In this manner, sliding vane 156 and rolling piston 150 divide cylindrical cavity 142 into a suction volume 160 and a compression volume 162. Casing 140 further defines a suction port 164 in fluid communication with suction volume 160 and a discharge port 166 in fluid communication with compression volume 162. In general, the rolling piston compressor 100 varies compression volume 162 while rolling piston 150 performs an eccentric rotary or orbiting motion in cylindrical cavity 142 about central axis 134. Sliding vane 156 maintains contact with cylindrical outer surface 152 to maintain a seal between suction volume 160 and compression volume 162.

Pump assembly 122 may further include a discharge valve 168 that is operably coupled to discharge port 166. In this manner, discharge valve 168 prevents the discharge of compressed refrigerant from compression volume 162 until a desired pressure is reached. In addition, discharge valve 168 may prevent the backflow of refrigerant into compression volume 162 from discharge port 166.

Operation of compressor 100 is controlled by a controller or processing device 178 (FIG. 3) that is operatively coupled to electric motor 120 for regulating operation of compressor 100, e.g., by selectively energizing electric motor 120. Specifically, controller 178 is in operative communication with the motor and may selectively energize stator 124 to drive rotor 126 and compress refrigerant as described above. Thus, controller 178 may generally be configured for executing selected methods of operating compressor 100, e.g., as described below.

According to exemplary embodiments, controller 178 may be configured for implementing field-oriented control (FOC) of electric motor 120. For example, electric motor may be a brushless DC (BLDC) motor controlled using an FOC algorithm that facilitates efficient operation, quick dynamic response, etc. In addition, as will be appreciated by one having ordinary skill in the art, the use of FOC controller may include the determination of several important variables of compressor operation 100, some of which may be used in the methods described herein for improved compressor control and pressure monitoring. For example, the FOC control may return an approximation of the load torque acting on rolling piston 150, the angle of such torque, etc.

As described in more detail below, controller 178 may include a memory and microprocessor, such as a general or special purpose microprocessor operable to execute programming instructions or micro-control code associated with methods described herein. Alternatively, controller 178 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Compressor 100 and other components of the associated appliance may be in communication with controller 178 via one or more signal lines or shared communication busses.

FIG. 3 depicts certain components of controller 178 according to example embodiments of the present disclosure. Controller 178 can include one or more computing device(s) 180 which may be used to implement methods as described herein. Computing device(s) 180 can include one or more processor(s) 180A and one or more memory device(s) 180B. The one or more processor(s) 180A can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 180B can include one or more non-transitory computer-readable storage medium(s), such as RAM, ROM, EEPROM, EPROM, flash memory devices, magnetic disks, etc., and/or combinations thereof.

The memory device(s) 180B can include one or more computer-readable media and can store information accessible by the one or more processor(s) 180A, including instructions 180C that can be executed by the one or more processor(s) 180A. For instance, the memory device(s) 180B can store instructions 180C for running one or more software applications, displaying a user interface, receiving user input, processing user input, etc. In some implementations, the instructions 180C can be executed by the one or more processor(s) 180A to cause the one or more processor(s) 180A to perform operations, e.g., such as one or more portions of methods described herein. The instructions 180C can be software written in any suitable programming language or can be implemented in hardware. Additionally, and/or alternatively, the instructions 180C can be executed in logically and/or virtually separate threads on processor(s) 180A.

The one or more memory device(s) 180B can also store data 180D that can be retrieved, manipulated, created, or stored by the one or more processor(s) 180A. The data 180D can include, for instance, data to facilitate performance of methods described herein. The data 180D can be stored in one or more database(s). In some implementations, the data 180D can be received from another device.

The computing device(s) 180 can also include a communication module or interface 180E used to communicate with one or more other component(s) of controller 178 or refrigerator appliance 10 over the network(s). The communication interface 180E can include any suitable components for interfacing with one or more network(s), including for example, transmitters, receivers, ports, controllers, antennas, or other suitable components.

Figure 6:
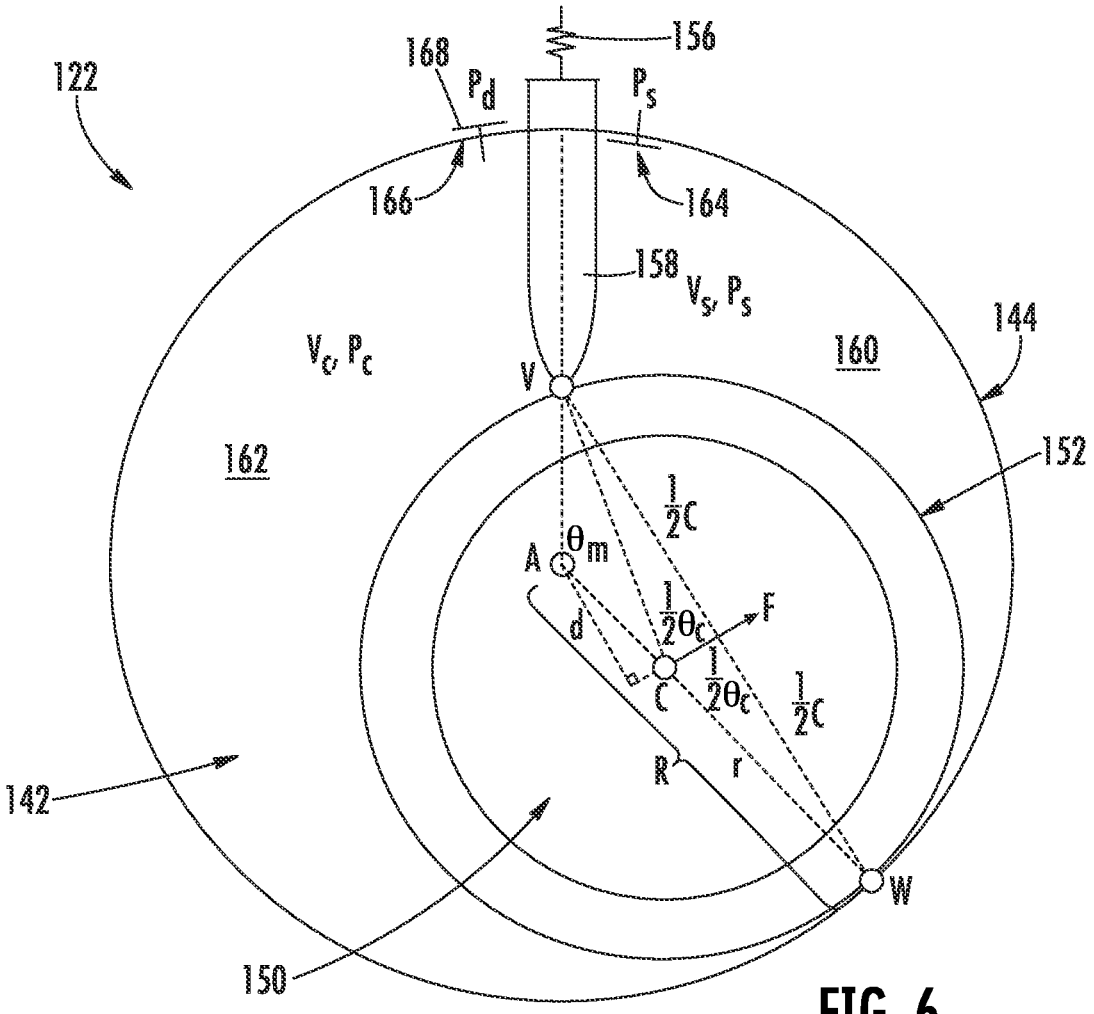
FIG. 6 provides a schematic, cross sectional view of the exemplary rolling piston rotary compressor including the geometric relationship and forces acting on the rolling piston.

Referring now specifically to FIG. 6, a schematic, cross sectional view of an exemplary rolling piston rotary compressor is provided. Specifically, FIG. 6 illustrates the geometric relationship between the eccentrically mounted rolling piston 150, the cylindrical cavity 142, and the sliding vane 156. Also illustrated are various forces exerted on rolling piston 150, along with an identification ofthe various chambers and their compression volumes. For convenience and to facilitate discussion below, a list ofthe system parameters associated with the discharge pressure estimation methods described herein is provided below in Table 1. However, it should be appreciated that fewer than all parameters may be listed here.

TABLE 1

List of Rolling Piston Operating Variables and Parameters

| Symbol | Parameter/Variable |
|---|---|
| A | axis of piston rotation (i.e., coincides with central axis 134) |
| C | center of piston mass |
| V | point of contact between piston and vane |
| W | point of contact between piston and wall |
| R | radius of compression chamber (i.e., cylindrical cavity 142) |
| r | radius of eccentrically mounted rolling piston 150 |
| $V_c$ | compression chamber volume (162) |
| $P_c$ | compression chamber pressure |
| $V_s$ | suction chamber volume (160) |
| $P_s$ | suction chamber pressure |
| $P_d$ | discharge pressure |
| $\theta_m$, $\theta_{m\text{-}p}$ | Load torque angle and peak load torque angle |
| $T_L$, $T_{L\text{-}p}$ | Load torque and peak load torque exerted on piston |
| $\gamma$ | Conversion factor that is function of $\theta_m$ |
| $\Delta P$ | Pressure difference between discharge and suction ($P_c - P_s$) |
| $r_p$ | Pressure ratio between discharge and suction ($P_d/P_s$) |
| $\omega$ | Angular speed of piston |

Referring still to FIG. 6, $\theta_m$ is measured as the angle between a first line that extends between an axis of piston rotation (A, i.e., which coincides with central axis 134) and a point of contact between the rolling piston and the vane (V) and a second line that extends between the axis of piston rotation A and a center of the piston mass (C) (e.g., also referred to by reference numeral 154). This angle may be used herein generally to refer to the load torque angle ($\theta_m$).

During operation of compressor 100, rolling piston 150 is mounted to rotor 126 of electric motor 120 such that it rotates and translates within cylindrical cavity 142. Notably, rolling piston 150 is mounted off center from rotor 126, i.e., such that the drive axis of rotor 126 (i.e., central axis 134) is not coincident with center of piston mass 154 of rolling piston 150. In this manner, for example, as rolling piston 150 rotates clockwise, the compression volume $V_c$ decreases causing gas compression and the increase of the pressure in the compression chamber $P_c$. Simultaneously, additional refrigerant is pulled in through suction port 164 into the suction volume $V_s$ for compression during the next piston rotation.

Rolling piston 150 continues to compress the gas until the pressure in the compression chamber exceeds the discharge pressure $P_d$, when discharge valve (e.g., such as discharge valve 168) opens, allowing the pressurized gas to be expelled causing the pressure in the compression chamber $P_c$ to hold constant at the discharge pressure $P_d$ until top dead center is passed. In this regard, discharge valve 168 may be a one-way valve that has a cracking pressure equal to the discharge pressure $P_d$ or may be a valve that is operated by controller 178. Alternatively, any other suitable valve may be used to regulate the discharge of gas from the compression chamber.

As rolling piston 150 rotates, thereby compressing the gas in the compression chamber, it simultaneously expands the volume of the suction chamber $V_s$. This volume expansion creates a negative pressure that opens a suction valve or otherwise draws in new gas into the cylinder from the inlet conduit. Notably, when rolling piston 150 crosses top dead center (TDC), the compression volume $V_c$ reduces to zero and rolling piston 150 begins compressing what was formerly the volume of the suction chamber $V_s$ and a new suction volume $V_s$ begins increasing from zero as the rolling piston rotates through another rotation past TDC. As explained briefly above, the compression process exerts a very uneven load on rolling piston 150 and thus electric motor 120 and compressor 100 in general. For example, during the compression part of the cycle the load torque increases dramatically, and after the high pressure gas is discharged the other half of the cycle has very little load.

Figure 7:
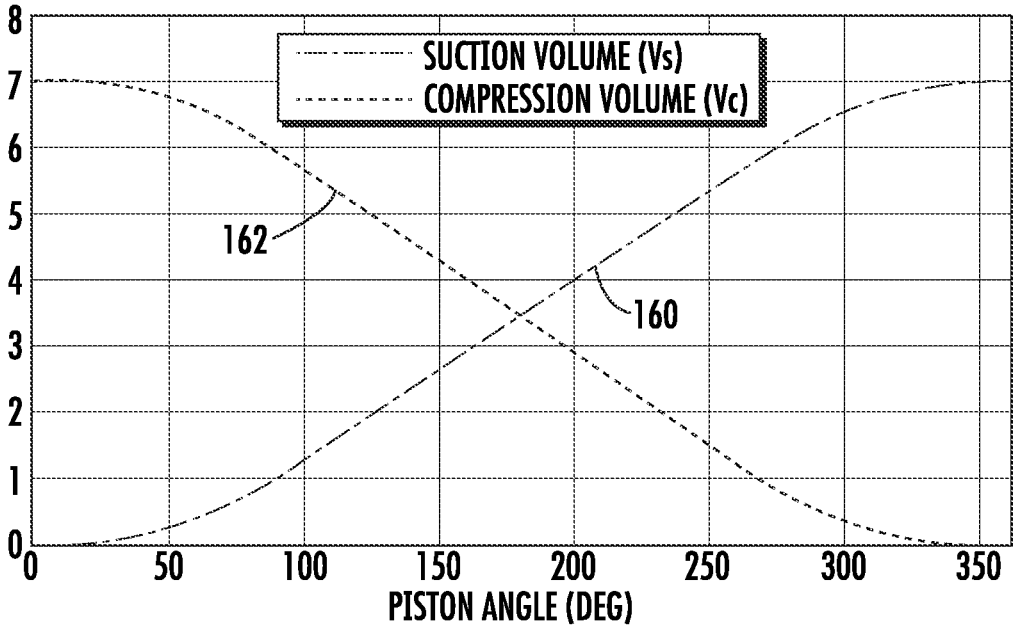
FIG. 7 provides a plot of a compression chamber volume and a suction chamber volume relative to an angle of the rolling piston according to an exemplary embodiment of the present subject matter.

In order to better understand the formulation and method below, the system dynamics of a rolling piston compressor (e.g., such as compressor 100) will be described according to an exemplary embodiment. For example, FIG. 7 illustrates the compression chamber volume ($V_c$, 162) and the suction chamber volume ($V_s$, 160) as rolling piston 150 rotates 360° within cylindrical cavity 142 starting from top dead center (e.g., θm=0). As shown, the compression volume is initially maximized and the suction volume is minimized. As rolling piston 150 rotates, the compression volume decreases while the suction volume increases, resulting in increased compression chamber pressure ($P_c$) and in the drawing of refrigerant into suction chamber volume ($V_s$) at a relatively constant suction chamber pressure ($P_s$), e.g., to be compressed during the next rotation.

In general, the compression chamber pressure ($P_c$) can be represented by the following equation, wherein $V_{TDC}$ is the top dead center volume or $V_{TDC}=V_c(0)$ and k is a specific heat ratio of the working gas.

$$P_c = \min\left(P_s\left(\frac{V_{TDC}}{V_c(\theta_m)}\right)^k, P_d\right)$$

Figure 8:
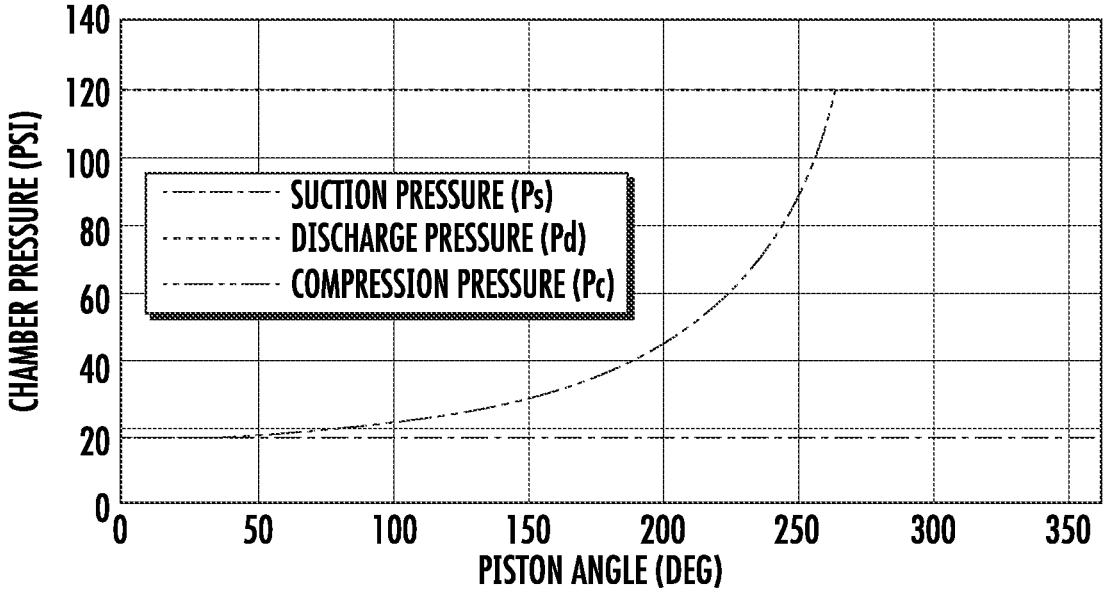
FIG. 8 provides a plot of a suction chamber pressure, a compression chamber pressure, and a discharge pressure relative to an angle of the rolling piston according to an exemplary embodiment of the present subject matter.

Referring now also to FIG. 8, the suction chamber pressure ($P_s$), the compression chamber pressure ($P_c$), and the discharge pressure ($P_d$) are illustrated according to an exemplary embodiment. As shown, the suction chamber pressure ($P_s$) remains relatively constant throughout the cycle as suction chamber volume ($V_s$) is supplied from a source of refrigerant. By contrast, discharge valve 168 remains closed and the compression chamber pressure ($P_c$) increases as the compression chamber volume ($V_c$) decreases. Once the cracking pressure of discharge valve 168 is reached or the valve is otherwise opened, the compression chamber pressure ($P_c$) is equal to the discharge pressure ($P_d$) for the remainder of the rotation as gas is expelled from discharge port 166.

Figure 9:
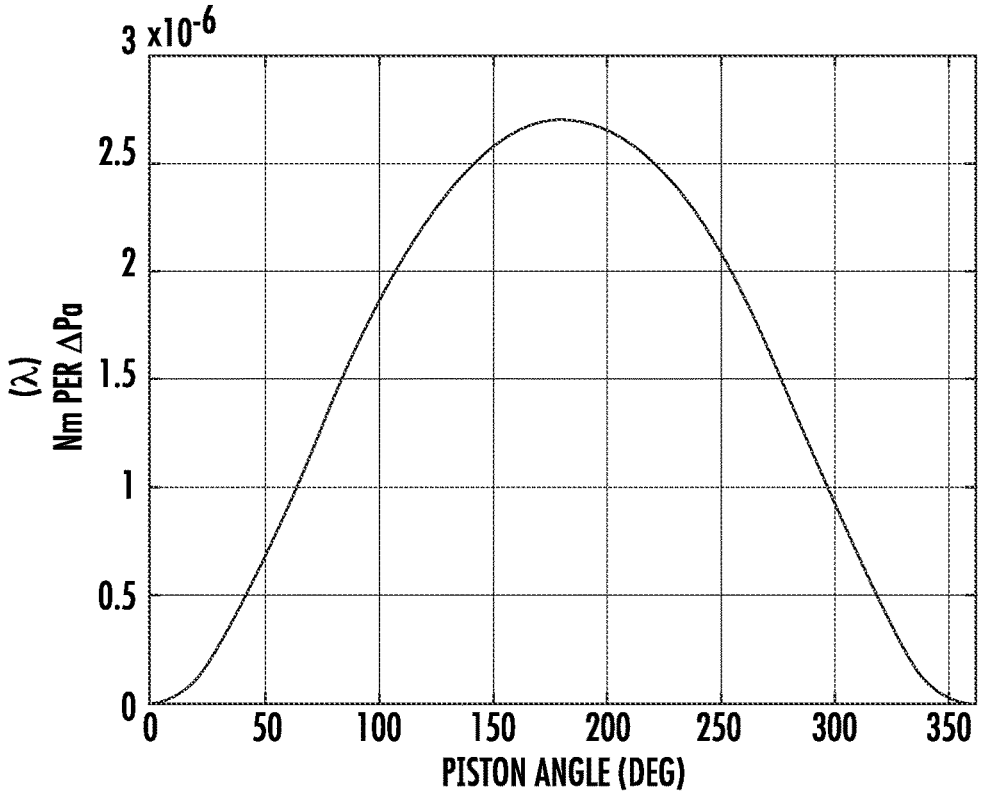
FIG. 9 provides a plot of a conversion factor for a rolling piston compressor relative to an angle of the rolling piston according to an exemplary embodiment of the present subject matter.

Notably, the pressure difference (ΔP) between the discharge pressure ($P_d$) and the suction pressure ($P_s$) creates a force (F, see FIG. 6) that acts on the piston, resulting in a load torque ($T_L$). This force (F) varies depending on the cross-sectional area separating the chamber, and thus on the angle of rolling piston or the load torque angle ($\theta_m$) and the pressure difference (ΔP). For example, the load torque ($T_L$) depends on the area over which the force (F) is acting, which is a function of the load torque angle ($\theta_m$). These geometric effects on the load torque ($T_L$) may be summarized in a conversion factor (γ) that is a function of the load torque angle ($\theta_m$). Referring now briefly to FIG. 9, the conversion factor (γ) for a given rolling piston compressor (e.g., compressor 100) over a single rotation of rolling piston 150 is illustrated according to an exemplary embodiment. Notably, the load torque ($T_L$) may also vary according to the angle of the force vector (F) and the center of rotation (C), e.g., as identified in FIG. 6 by ($\theta_C$).

Figure 10:
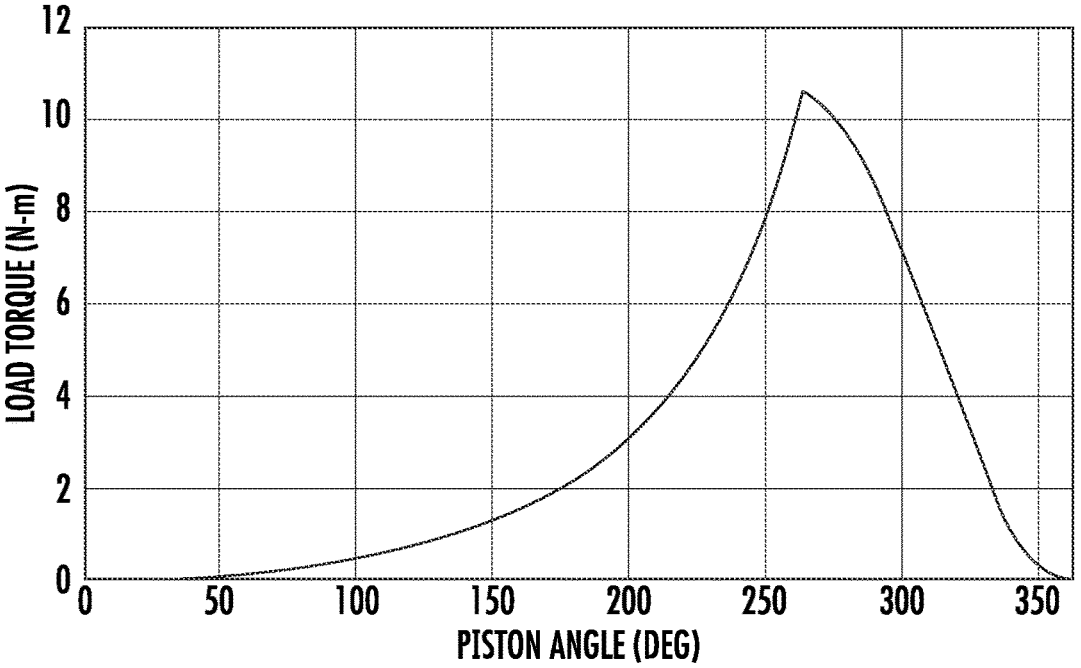
FIG. 10 provides a plot illustrating the relationship between a piston angle of a rolling piston and a resulting load torque exerted on the rolling piston according to an exemplary embodiment of the present subject matter.

By knowing the pressure differential (ΔP) and the conversion factor (γ) that compensates for the geometrical relationship of the compressor and the area over which the force associated with the pressure differential (ΔP) acts, the load torque as a function of the load torque angle ($\theta_m$) may be obtained. For example, FIG. 10 illustrates the load torque ($T_L$) as rolling piston 150 makes a full rotation within cylindrical cavity 142. Combining the geometrical considerations of the rolling piston compressor 100, the load torque ($T_L$) may be characterized as follows:

$$T_L=\gamma(\theta_m)\cdot\Delta P=\gamma(\theta_m)\cdot(P_c-P_s)$$

Notably, as best shown in FIG. 10, the load torque ($T_L$) may always drop to zero when the rolling piston 150 is top dead center (e.g., $\theta_m=0$). In addition, the load torque ($T_L$) peaks at a peak load torque ($T_{L-p}$) when discharge valve 168 opens. Notably, by identifying the mechanical angle or load torque angle ($\theta_m$) when the peak load torque ($T_{L-p}$) occurs, we can determine or infer the pressure ratio ($r_p$) between discharge and suction ($P_d/P_s$), e.g., based on the plot illustrated in FIG. 8 or using related empirically based models.

According to exemplary embodiments, the load torque ($T_L$) and the load torque angle ($\theta_m$) may be determined in any suitable manner. For example, any suitable number and types of sensors may be used to monitor these values. According to exemplary embodiments, and as explained above, the FOC control could be used to obtain these values. For example, a sensorless FOC algorithm for synchronous motor driven compressor may include an estimate of the angle of the rotor magnetic field, which could be translated to the mechanical angle of the rotor piston. Such an FOC control may also include speed feedback and a speed control loop that adjusts the torque applied to the motor. Through this information (e.g., motor torque, speed), an estimate of the load torque acting against the motor could be obtained. In addition, the peak load torque ($T_{L-p}$) may be determined from the load torque ($T_L$) plot.

Moreover, it should be appreciated that various signals representative of the load torque may be used instead of the actual load torque. For example, the motor current or some other torque analogous signal may be used as a proxy for load torque or may be used to approximate the actual load torque. Accordingly, as used herein, the terms "load torque" and the like may generally refer to the actual load torque or to such analogous signals.

Aspects of the present subject matter may rely on a principle that the peak load torque will coincide with the opening of the discharge valve. In general, using the load torque conversion curve, we can see that this will be true so long as the discharge valve opens at $\theta_m \geq 180°$, e.g., as seen in the chamber pressure plot of FIG. 8. In this regard, $\theta_m = 180°$ yields $$V_c(\theta_m) = \frac{V_{TDC}}{2}$$

which gives us $P_c(180°) = P_s \cdot 2^k$ (from the earlier pressure equation). If the discharge valve is opened at this angle or higher, then we have $P_c(180°) = P_s \leq 2^k$; $P_d$. Thus, this condition will be met so long as the pressure ratio $r_P \geq 2^k$ (where $$r_P = \frac{P_d}{P_s}).$$

Most refrigerants have a specific heat ratio slightly above 1, which sets the minimum pressure ratio for our assumption somewhere above 2. This is a relatively low pressure ratio, which should be easily met by most real world operating conditions.

Given an angle for the peak load torque $\theta_{m_p}$, $$r_P = \frac{P_d}{P_s}$$

can be calculated by working backward based on the assumption that at this point the discharge value is opening, i.e., $P_c$ has reached $P_d$. Substituting $P_c(\theta_{m_p}) = P_d$ into our pressure equation results in the following derivation of the pressure ratio ($r_p$):

$$P_c(\theta_{m-p}) = P_d = P_s\left(\frac{V_{TDC}}{V_c(\theta_{m-p})}\right)^k \Rightarrow r_P = \left(\frac{V_{TDC}}{V_c(\theta_{m-p})}\right)^k$$

Notably, $V_c(\theta_m)$ is a fixed curve determined by the compressor geometries, and $V_{TDC}$ and k are both constants. Accordingly, a curve or lookup table (or regression equation or other model) may be empirically determined or derived to permit the determination of the pressure ratio ($r_p$) in accordance with the following equation:

$$r_P = \left(\frac{V_{TDC}}{V_c(\theta_{m-p})}\right)^k.$$

Now that the pressure ratio ($r_p$) has been determined, aspects of the present subject matter include determining the delta pressure or pressure difference ($\Delta P$) from the peak load torque ($T_{L-p}$). In this regard, recall that the load torque relates to the pressure difference ($\Delta P$) shown below, wherein the conversion factor $\gamma(\theta_m)$ is defined by the compressor geometries and can be stored as an equation or lookup table:

$$T_L = \gamma(\theta_m)(P_c - P_s)$$

Once the discharge valve has opened, the compression chamber pressure ($P_c$) is equal to the discharge pressure ($P_d$), which results in a simplified load torque equation as provided below:

$$T_L = \gamma(\theta_m)\Delta P$$

Given this relationship, the pressure difference ($\Delta P$) can be directly solved for using the values of the peak load torque ($T_{L-p}$) and the peak load torque angle ($\theta_{m-p}$), as follows:

$$\Delta P = \frac{T_{L-p}}{\gamma(\theta_{m-p})}$$

Noting that this relationship holds for any point after the discharge valve has opened, the single point $\theta_{m_p}$ can be used to estimate $\Delta P$ for all torque and angle values in the range $\theta_m \in [\theta_{m-p}, 2\pi)$. This presents the opportunity to use a more sophisticated method to estimate $\Delta P$ over the given range (e.g., regression or adaptive methods).

Once the pressure ratio ($r_p$) and the pressure difference ($\Delta P$) have been determined, algebraic methods may be used to determine the discharge pressure ($P_d$) and the suction pressure ($P_s$), as shown below:

$$P_d = \frac{\Delta P}{1 - 1/r_P}, \; P_s = \frac{\Delta P}{r_P - 1}$$

As explained above, the relationship between load torque ($T_L$), load torque angle ($\theta_m$), suction pressure ($P_s$), discharge pressure ($P_d$), and other system variables and parameters are determined theoretically using a model of system dynamics and various mathematical formulas representing such dynamics. However, it should be appreciated that according to alternative embodiments, these relationships may instead be determined empirically. For example, the relationship between discharge pressure and the angle and value of the peak load torque for a given compressor design may be monotonic for both input variables and may be relatively linear, which facilitates easy characterization and utilization. In addition, while the amplitude and peak angle of the load torque are used herein as input parameters for such a characterization, there are many other parameters that could be selected. For example, in cases where the angle feedback cannot be confidently aligned with the piston, we can use the angle delta from the peak to the trough of the load torque signal as an input parameter. Since the trough of the load torque should always coincide with $\theta_m = 2\pi$, this angle delta should in theory be equal to $2\pi - \theta_{m-p}$. In another example, the average value of the load torque over a compression cycle may be used in place of its peak value, with the assumption that the two are highly correlated. Other signals which are directly related to the torque such as motor current may also be used for convenience.

Figure 11:
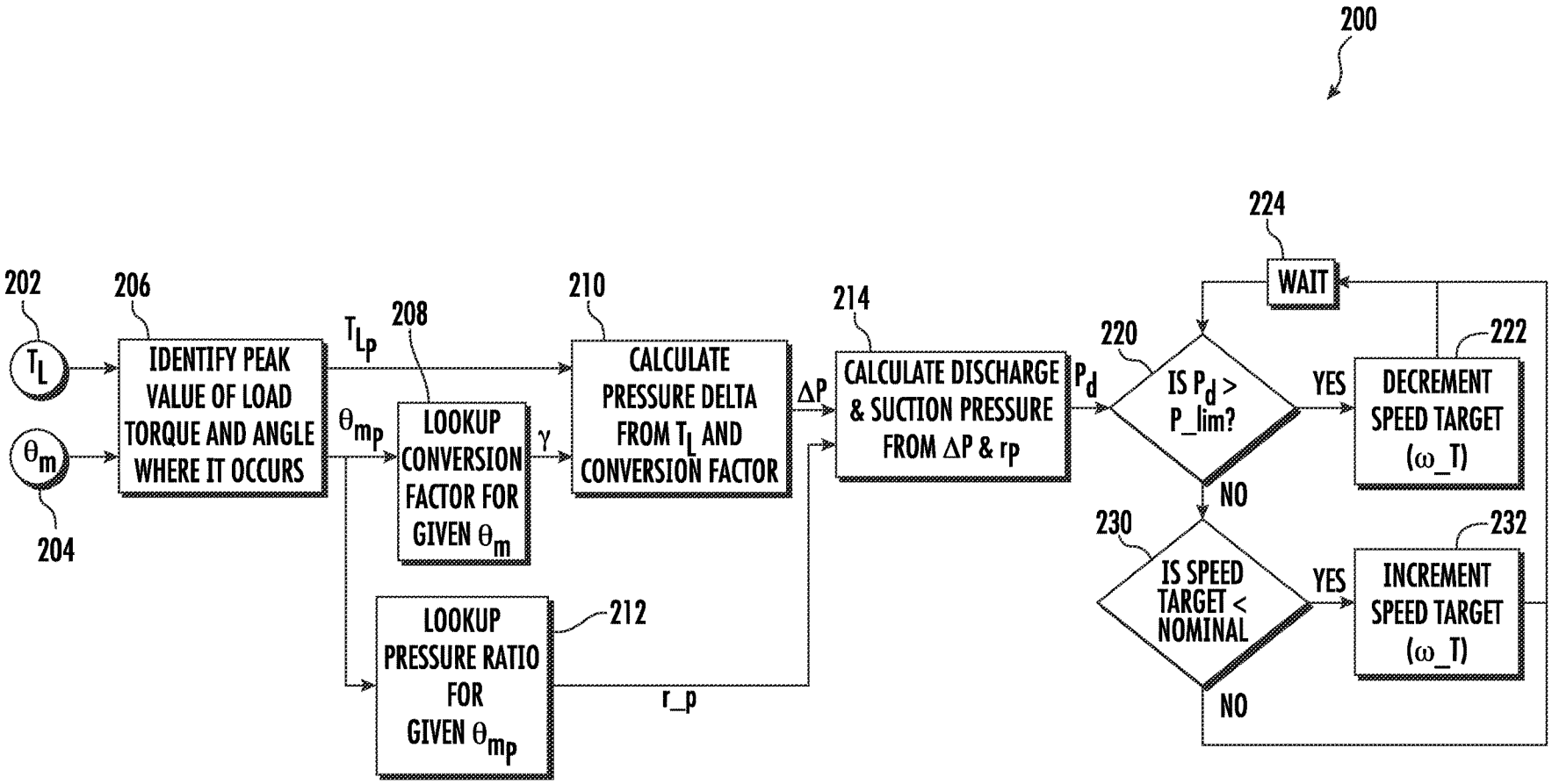
FIG. 11 provides an exemplary control schematic and method for regulating operation of the exemplary rolling piston rotary compressor of FIG. 3 according to an exemplary embodiment.

Referring now to FIG. 11, an exemplary control schematic or method 200 of operating a compressor will be described according to an exemplary embodiment of the present subject matter. Method 200 may be used to operate any suitable compressor. For example, method 200 may be used to operate rolling piston compressor 100 or may be adapted for controlling any other suitable compressor type and configuration. According to an exemplary embodiment, controller 178 of refrigerator appliance 10 may be programmed or configured to implement method 200. Thus, method 200 is discussed in greater detail below with reference to rolling piston compressor 100. Utilizing method 200, the motor of compressor 100 may be operating according to various control methods.

FIG. 11 and the associated description below provide an explanation and formulation of a pressure estimation model or technique that may be used to estimate the discharge pressure ($P_d$) of compressor 100 without the use of complex pressure sensors or switches. In this regard, a suitable controller, such as an appliance controller or a dedicated motor controller, may be used to operate the drive motor such that the compressor operates to achieve target rotational speeds ($\omega$) while ensuring that system pressures do not exceed predetermined thresholds.

To simplify explanation of the formulation of the pressure estimation model, certain steps in the formulation process may be omitted, particularly where the mathematics are simple or the derivation is implied. The description of the control algorithm and method 200 are intended to describe only a single method of formulating a pressure estimation model and regulating a compressor. According to alternative embodiments, assumptions may be made to simplify the calculation, e.g., where such an assumption simplifies the computational requirements of controller without sacrificing accuracy beyond a suitable degree.

Referring now specifically to FIG. 11, method 200 may include, at step 202, obtaining the load torque ($T_L$), and at step 204, obtaining the load torque angle ($\theta_m$). As explained above, these parameters may be obtained from the FOC control being implemented to operate compressor 100. According to exemplary embodiments, the obtained load torque profile over a single revolution of rolling piston 150 is illustrated in FIG. 10. Accordingly, method may include obtaining the load torque exerted on the rolling piston for each load torque angle as the rolling piston rotates. Although FOC control is described herein as being used to obtain these values, it should be appreciated that these parameters may be obtain in any other suitable manner, e.g., using sensors, etc.

Step 206 may include identifying the peak values of the load torque ($T_L$) and the load torque angle ($\theta_m$) where this peak torque occurs. These peak values may be identified herein as the peak load torque ($T_{L\text{-}p}$) and the peak load torque angle ($\theta_{m\text{-}p}$). For example, referring briefly to FIG. 10, the peak load torque is approximately 11 N-m and the corresponding peak load torque angle is approximately 270°. It should be appreciated that any suitable mathematical procedures may be used to estimate these values from the data obtained, such as averaging, filtering, or any other suitable method.

Step 208 may generally include determining a conversion factor ($\gamma$) which is a function of the load torque angle ($\theta_m$). Specifically, according to an exemplary embodiment this conversion factor may be determined using a lookup table that include empirically determined values that are based on the geometry and parameters of compressor 100. According to exemplary embodiments, this lookup table, database, regression equation, or other suitable model may be stored locally on controller 178 or at any other suitable accessible location.

Step 210 generally includes calculating a pressure delta or pressure difference ($\Delta P$) based on the load torque and the conversion factor, e.g., using the equation provided above. In addition, step 212 includes determining a pressure ratio ($r_p$) as a function of the torque load angle ($\theta_m$), e.g., using the equation provided above. Once the pressure difference ($\Delta P$) and pressure ratio ($r_p$) have been obtained, step 214 may include calculating the discharge pressure ($P_d$) and/or the suction pressure ($P_s$) using the algebraically formulated equations above. Notably, as explained, according to exemplary embodiments, steps 206-214 may be performed using an empirically generated model or algorithm that accounts for the geometric constraints and operating characteristics/dynamics of a given compressor. According to such an embodiment, inputting a load torque and angle could generated a discharge pressure useful for the remainder of method 200. Accordingly, method 200 may includes estimating a discharge pressure ($P_d$) within the compression volume based at least in part on a load torque ($T_L$) and a load torque angle ($\theta_m$).

Step 220 includes determining whether the discharge pressure ($P_d$) is greater than a predetermined threshold limit ($P_{d\text{-}limit}$) on the discharge pressure ($P_d$). In this regard, the discharge pressure limit may be set by a manufacturer of the compressor to ensure that the discharge pressure (which is commonly the highest pressure in the sealed system) remains below regulatory or desired safety limits (e.g., such as UL safety standards). According to exemplary embodiments, the discharge pressure limit may be set to approximately one-third of a burst pressure of the sealed system. Other suitable discharge pressure limits may be used while remaining within the scope of the present subject matter.

If the discharge pressure exceeds the discharge pressure limit, step 222 may include adjusting the at least one operating parameter of the rolling piston compressor, e.g., to decrease the discharge pressure ($P_d$). For example, adjusting the at least one operating parameter may include decrementing or lowering a compressor speed target (dr). In this manner, by lowering the speed of the compressor, the discharge pressure should be driven toward a more acceptable range. According to other example embodiments, adjusting the at least one operating parameter may include lowering a current limit or a torque limit for the rolling piston compressor.

Step 224 may include waiting for the sealed system to stabilize before passing back to step 220. When the discharge pressure drops below the discharge pressure limit, method 200 may proceed to block 230, which includes determining whether the compressor speed target has fallen below some predetermined nominal speed ($\omega_{nom}$). If the compressor speed target is still in the acceptable range, the process may proceed to step 224. However, in the event that the compressor speed target falls below the predetermined nominal speed, step 232 may include incrementing or increasing the speed target. The method 200 may once again include waiting at step 224 for the system to normalize before proceeding back to step 220 to again ensure that the discharge pressure is not too high.

FIG. 11 depicts an exemplary control method and models having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using rolling piston rotary compressor 100 as an example, it should be appreciated that these methods may be applied to the operation of any suitable compressor type and configuration.

As explained above, aspects of the present subject matter are directed to pressure estimation for a rolling piston compressor in a refrigerator, an air conditioner, or other sealed system application. In this regard, the discharge and suction pressures of the compressor may be inferred sensorlessly by monitoring the load torque acting against the compressor motor. The approximation of the load torque acting on the piston eccentric may be obtained from the motor control. The sensorless field-oriented control (FOC) algorithm for synchronous motor driven compressor may include an estimate of the angle of the rotor magnetic field, which may be translated to the mechanical angle of the rotor piston. Such FOC control would also include speed feedback and a speed control loop that adjusts the torque applied to the motor. Through this information (e.g., motor torque and speed), an estimate of the load torque acting against the motor may be obtained.

Accordingly exemplary embodiments, the control method may include using a load torque signal (available from FOC control) to infer discharge and suction pressures of the compressor based on the amplitude and phase of the load torque. For example, this inference may be achieved by recognizing the relationships between the peak load angle, the pressure ratio, the peak load torque angle, the pressure difference between suction and discharge, and other variables, parameters, or constants. For example, in this manner, the suction and discharge pressures can be algebraically reconstructed from the pressure ratio and pressure difference. Once the discharge pressure is identified, then a limit can be set which triggers a pullback scheme to reduce the discharge pressure back to a safe level (e.g., instead of shutting down the compressor altogether). Thus, this method for sensorlessly estimating the discharge and suction pressures facilitates cost savings and performance improvements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a rolling piston compressor, the rolling piston compressor comprising a casing defining a cylindrical cavity defining a central axis, a suction port, and a discharge port, a rolling piston positioned within the cylindrical cavity, and a sliding vane that extends from the casing toward the rolling piston to maintain contact with the rolling piston as it rotates about a central axis, the sliding vane and the rolling piston dividing the cylindrical cavity into a suction volume in fluid communication with the suction port and a compression volume in fluid communication with the discharge port, the method comprising:

estimating a discharge pressure ($P_d$) within the compression volume based at least in part on a load torque ($T_L$) and a load torque angle ($\theta_m$), wherein estimating the discharge pressure ($P_d$) comprises:

determining a pressure difference ($\Delta P$) between the discharge pressure ($P_d$) within the compression volume and a suction pressure ($P_s$) within the suction volume;

determining a pressure ratio ($r_p$) equal to the discharge pressure ($P_d$) over the suction pressure ($P_s$); and estimating the discharge pressure ($P_d$) based at least in part on the pressure difference ($\Delta P$) and the pressure ratio ($r_p$);

determining that the discharge pressure ($P_d$) is greater than a predetermined pressure limit ($P_{d\text{-}limit}$); and adjusting at least one operating parameter of the rolling piston compressor to decrease the discharge pressure ($P_d$).

2. The method of claim 1, wherein determining the pressure difference ($\Delta P$) between the discharge pressure ($P_d$) within the compression volume and the suction pressure ($P_s$) within the suction volume comprises:

determining the pressure difference ($\Delta P$) based at least in part on the load torque ($T_L$) and a conversion factor ($\gamma$), wherein the conversion factor is a function of the load torque angle ($\theta_m$).

3. The method of claim 2, wherein determining the pressure difference ($\Delta P$) based at least in part on the load torque ($T_L$) and the conversion factor ($\gamma$) comprises using the following equation:

$$\Delta P = \frac{T_L}{\gamma(\theta_m)}.$$

4. The method of claim 3, wherein the conversion factor ($\gamma$) is obtained using a lookup table stored in a controller.

5. The method of claim 1, wherein determining the pressure ratio ($r_p$) equal to the discharge pressure ($P_d$) over the suction pressure ($P_s$) is based at least in part on determining a peak load torque angle ($\theta_{m\text{-}p}$).

6. The method of claim 5, wherein determining the pressure ratio ($r_p$) equal to the discharge pressure ($P_d$) over the suction pressure ($P_s$) comprises using the following equation:

$$r_p = \left(\frac{V_{TDC}}{V_c(\theta_{m-p})}\right)^k$$

where: $V_{TDC}$=the compression volume when the rolling piston is at top dead center;

$V_c(\theta_{m\text{-}p})$=the compression volume at the peak load torque angle ($\theta_{m\text{-}p}$); and k=a constant.

7. The method of claim 1, wherein the pressure ratio ($r_p$) is obtained using a lookup table stored in the controller as a function of the peak load torque angle ($\theta_{m\text{-}p}$).

8. The method of claim 1, wherein the load torque ($T_L$) and the load torque angle ($\theta_m$) are obtained by a motor controller implementing field-oriented control (FOC).

9. The method of claim 1, wherein the predetermined pressure limit ($P_{d\text{-}limit}$) is one-third of a burst pressure of a sealed system of a refrigerator appliance.

10. The method of claim 1, wherein adjusting the at least one operating parameter of the rolling piston compressor to decrease the discharge pressure ($P_d$) comprises:

lowering a target speed ($\omega_{target}$) of the rolling piston compressor.

11. The method of claim 1, wherein adjusting the at least one operating parameter of the rolling piston compressor to decrease the discharge pressure ($P_d$) comprises:

lowering a current limit or a torque limit for the rolling piston compressor.

12. The method of claim 1, further comprising:

determining that the discharge pressure ($P_d$) is below the predetermined pressure limit ($P_{d\text{-}limit}$);

determining that a target speed ($\omega_{target}$) is below a nominal speed ($\omega_{nominal}$); and increasing the target speed ($\omega_{target}$) of the rolling piston compressor.

13. The method of claim 1, wherein estimating the discharge pressure ($P_d$) within the compression volume based at least in part on the load torque ($T_L$) and the load torque angle ($\theta_m$) comprises:

empirically determining a relationship between the load torque ($T_L$), the load torque angle ($\theta_m$), and the discharge pressure ($P_d$).

14. The method of claim 1, wherein the rolling piston compressor is used to compress a refrigerant in a sealed system of a refrigerator appliance or an air conditioner unit.

15. A rolling piston compressor comprising:

a casing defining a cylindrical cavity defining a central axis, a suction port, and a discharge port;

an electric motor comprising a drive shaft, the drive shaft extending along the central axis;

a rolling piston positioned within the cylindrical cavity, the rolling piston being eccentrically mounted on the drive shaft;

a sliding vane that extends from the casing toward the rolling piston to maintain contact with the rolling piston as it rotates about the central axis, the sliding vane and the rolling piston dividing the cylindrical cavity into a suction volume in fluid communication with the suction port and a compression volume in fluid communication with the discharge port; and a controller operably coupled to the electric motor, the controller configured for:

estimate a discharge pressure ($P_d$) within the compression volume based at least in part on a load torque ($T_L$) and a load torque angle ($\theta_m$), wherein estimating the discharge pressure ($P_d$) comprises empirically determining a relationship between the load torque ($T_L$), the load torque angle ($\theta_m$), and the discharge pressure ($P_d$);

determine that the discharge pressure ($P_d$) is greater than a predetermined pressure limit ($P_{d\text{-}limit}$); and adjust at least one operating parameter of the rolling piston compressor to decrease the discharge pressure ($P_d$).

16. The rolling piston compressor of claim 15, wherein estimating the discharge pressure ($P_d$) within the compression volume based at least in part on the load torque ($T_L$) and the load torque angle ($\theta_m$) comprises:

determining a pressure difference ($\Delta P$) between the discharge pressure ($P_d$) within the compression volume and a suction pressure ($P_s$) within the suction volume;

determining a pressure ratio ($r_p$) equal to the discharge pressure ($P_d$) over the suction pressure ($P_s$); and estimating the discharge pressure ($P_d$) based at least in part on the pressure difference ($\Delta P$) and the pressure ratio ($r_p$).

17. The rolling piston compressor of claim 16, wherein determining the pressure difference ($\Delta P$) between the discharge pressure ($P_d$) within the compression volume and the suction pressure ($P_s$) within the suction volume comprises:

determining the pressure difference ($\Delta P$) based at least in part on the load torque ($T_L$) and a conversion factor ($\gamma$), wherein the conversion factor is a function of the load torque angle ($\theta_m$) as shown in the following equation:

$$\Delta P = \frac{T_L}{\gamma(\theta_m)}.$$

18. The rolling piston compressor of claim 15, wherein adjusting the at least one operating parameter of the rolling piston compressor to decrease the discharge pressure ($P_d$) comprises:

lowering a target speed ($\omega_{target}$) of the rolling piston compressor.

19. A method for operating a rolling piston compressor, the rolling piston compressor comprising a casing defining a cylindrical cavity defining a central axis, a suction port, and a discharge port, a rolling piston positioned within the cylindrical cavity, and a sliding vane that extends from the casing toward the rolling piston to maintain contact with the rolling piston as it rotates about a central axis, the sliding vane and the rolling piston dividing the cylindrical cavity into a suction volume in fluid communication with the suction port and a compression volume in fluid communication with the discharge port, the method comprising:

estimating a discharge pressure ($P_d$) within the compression volume based at least in part on a load torque ($T_L$) and a load torque angle ($\theta_m$);

determining that the discharge pressure ($P_d$) is greater than a predetermined pressure limit ($P_{d\text{-}limit}$); and adjusting at least one operating parameter of the rolling piston compressor to decrease the discharge pressure ($P_d$) by lowering a current limit or a torque limit for the rolling piston compressor.

20. The method of claim 19, wherein estimating the discharge pressure ($P_d$) within the compression volume based at least in part on the load torque ($T_L$) and the load torque angle ($\theta_m$) comprises:

determining a pressure difference ($\Delta P$) between the discharge pressure ($P_d$) within the compression volume and a suction pressure ($P_s$) within the suction volume;

determining a pressure ratio ($r_p$) equal to the discharge pressure ($P_d$) over the suction pressure ($P_s$); and estimating the discharge pressure ($P_d$) based at least in part on the pressure difference ($\Delta P$) and the pressure ratio ($r_p$).

* * * * *